US006907623B2

(12) United States Patent
Beh

(10) Patent No.: US 6,907,623 B2
(45) Date of Patent: Jun. 21, 2005

(54) PRESSURIZED WATER CLOSET FLUSH SYSTEM

(75) Inventor: Thomas P. Beh, Royal Oak, MI (US)

(73) Assignee: Geberit Technik AG, Jona (CH)

( * ) Notice: Subject to any disclaimer, the term of this patent is extended or adjusted under 35 U.S.C. 154(b) by 0 days.

(21) Appl. No.: 10/264,200

(22) Filed: Oct. 3, 2002

(65) Prior Publication Data

US 2004/0064880 A1 Apr. 8, 2004

(51) Int. Cl.[7] ..... E03D 3/10

(52) U.S. Cl. ..... 4/354; 4/355; 4/356; 4/363; 4/364; 4/334

(58) Field of Search ..... 4/354, 334, 415, 4/355, 356, 357, 358, 359, 360–365

(56) References Cited

U.S. PATENT DOCUMENTS

| | | | | |
|---|---|---|---|---|
| 1,501,620 A | * | 7/1924 | Reed | 4/357 |
| 3,790,967 A | | 2/1974 | Pignato | |
| 4,233,698 A | | 11/1980 | Martin | |
| 5,361,426 A | | 11/1994 | Martin | |
| 5,363,513 A | * | 11/1994 | Blankenburg | 4/354 |
| 5,435,019 A | * | 7/1995 | Badders | 4/359 |
| 5,553,333 A | * | 9/1996 | Andersson | 4/354 |
| 5,970,527 A | * | 10/1999 | Martin et al. | 4/361 |
| 6,317,899 B1 | * | 11/2001 | Brewer | 4/365 |
| 6,343,387 B1 | | 2/2002 | Beh | |
| 6,360,378 B2 | * | 3/2002 | Martin | 4/359 |
| 6,457,187 B1 | * | 10/2002 | Andersson et al. | 4/359 |
| 6,550,076 B1 | * | 4/2003 | Fish | 4/359 |

FOREIGN PATENT DOCUMENTS

WO WO 2004/033808 * 4/2004 ..... E03D/3/10

* cited by examiner

*Primary Examiner*—Henry Bennett
*Assistant Examiner*—Amanda Wieker
(74) *Attorney, Agent, or Firm*—Reinhart Boerner Van Deuren s.c.

(57) ABSTRACT

A pressurized water closet flushing system for flushing a toilet includes a water vessel having at least one opening for receiving water. A fill tube and a discharge tube extending into the vessel are secured to the vessel. A modular assembly cap including an intake and an actuator covers the opening. The fill tube remains secured to the vessel when the assembly cap is removed from the vessel.

30 Claims, 9 Drawing Sheets

PRESSURIZED WATER CLOSET FLUSH SYSTEM

CROSS-REFERENCE TO RELATED PATENT APPLICATIONS

None.

BACKGROUND OF THE INVENTION

The present invention relates generally to the field of pressure assist water closet systems, and more particularly, to a pressure assist flush system for use with in-wall plumbing that is easy to service.

U.S. Federal Law currently requires that water closet systems do not exceed 1.6 gallons per flush (1.6 gpf). This standard has posed certain difficulties for standard gravity flush toilets. A gravity flush toilet relies on a combination of head pressure of the water in the holding tank and siphonic action in the trapway to provide the force to evacuate waste from a bowl. In order to meet the 1.6 gpf standard, new bowls include reduced trap size and reduced standing water surface area.

A pressure assist water closet system stores water under pressure to provide thrust to discharge the contents of a bowl during a flush cycle. The pressure is supplied by the pressure in the water supply line itself and no additional power is required. The water enters the storage vessel and trapped air is compressed. Since a liquid is non-compressible and air is compressible, the air will be compressed until the air pressure in the vessel is equal to the water supply line pressure. The pressure in the tank can be set not to exceed a certain value with a pressure regulator.

When the bowl is ready to be flushed the water in the vessel is released under pressure into the bowl, thereby thrusting the waste out of the bowl.

A pressure assist flush system provides a number of advantages over a traditional gravity flush system. First, the discharge pressure of the water is greater than that achieved in gravity assist units. The increased pressure allows for greater evacuation with less water by thrusting the waste out of the bowl. The pressurized water enables the use of discharge line with a greater diameter and greater surface area of standing water within the bowl.

Various pressure assist flush systems and improvements are described in U.S. Pat. No. 4,233,698 entitled "Pressure Flush Tank For Toilets" to Martin; U.S. Pat. No. 5,361,426 entitled "Hydraulically Controlled Pressurized Water Closet Flushing System" to Martin; U.S. Pat. No. 5,970,527 entitled "Pressurized Water Closet Flushing System" to Martin et al.; U.S. Pat. No. 6,360,378 entitled "Pressurized Water Closet Flushing System" to Martin; and U.S. Pat. No. 6,343,387 entitled "Volume Control For A Water Closet" to Beh. Each of these patents are incorporated herein by reference.

An increasing desire in plumbing construction is to place the closet water tanks within the bathroom walls. The in-wall system can be serviced through an access panel located on the wall. Any failure of the water tank system requires the ability to access the unit for repair or replacement. The reliability of pressure assist systems and the sealed environment of the vessels of the pressure assist units provide an ideal system for in-wall plumbing. However, since the access panel will provide a limited area in which to service any in-wall unit, it would be desirable to be able to easily access all of the components of the water tank system. Further, since the tank will be supported within the wall it would be desirable to provide a tank or vessel to minimize the pressure placed on the various components to reduce the number of component failures. It would also be desirable to provide a system that would fit within the envelope between the studs and walls of standard construction. It would further be desirable to provide fill and discharge tubes that remain within the vessel when servicing certain components of the pressure assist system. It would also be desirable to provide a controlled pressure relief valve to prevent damage to the device should a repair technician fail to properly depressurize the device prior to servicing the pressure assist unit. Given the tight envelope to service the pressure assist unit, it would be desirable to remove components from the vessel without tools. It would also be desirable to test components of the system outside of the wall environment and independent of the vessel why still hooked up to the in-wall plumbing.

SUMMARY OF THE INVENTION

One embodiment of the invention relates to pressurized water closet flushing system comprising a water vessel having at least one opening and a cap covering the opening. A fill tube extends into and is secured to the vessel. The fill tube remains secured to the vessel when the cap is removed.

Another embodiment of a pressurized water closet comprises a water vessel having at least one opening and a cap removeably secured to the opening. At least one o-ring seals the cap assembly to the water vessel. The water closet further includes means for releasably securing the cap assembly to the vessel.

Still another embodiment of a pressurized water closet flushing system comprises a vessel operatively connected to a water supply line through a first opening and operatively connected to a toilet through a second opening. A cap assembly sealing the first opening and secured to the vessel with a fastener. A pressure relief valve is operatively connected to the interior of the vessel and is closed when the fastener is in a fully engaged position. The pressure relief valve is released prior to the seal being broken as the fastener is moved a predetermined distance from the fully engaged position.

Another embodiment of the pressurized water closet flushing system comprises a vessel having a first upper opening and a second lower opening operatively connected to a toilet. A cap assembly operatively connects a water supply to the first opening and includes an actuator. The cap assembly is formed from at least two separate modules. Each module has a separate housing and the housings are releasably secured to each other without tools.

A further embodiment of a pressurized water closet for flushing a toilet comprises a vessel including an interior having an upper surface with a first opening operatively connected to a water supply line and a lower surface having a second opening operatively connected to the toilet. A non-pressurized mount is operatively connected to the lower surface. An extension extends from the mount and is secured directly to the toilet.

In still another embodiment a pressurized water closet flushing system is located within a wall and includes a pressurized water vessel having at least one opening. A cap assembly is removeably secured to the opening of the vessel. A release mechanism permits the removal of the cap assembly from the vessel without separate tools.

Another embodiment includes a method of repairing an in-wall pressurized water flush system having a pressurized water vessel and a cap assembly including an actuator where the vessel and cap assembly are located in a wall cavity. Pressure is released from within the pressurized vessel, a user then removes the cap assembly by reaching through an access opening in the wall and lifts the cap assembly off of the vessel. The cap assembly is then removed from the wall cavity through the access opening in the wall that is too small to remove the vessel.

In still another embodiment of a pressurized water flushing system includes a pressurized water vessel having a first opening and a second opening. A cap assembly is secured to a water intake line and to the opening in the water vessel. An electronic actuator is operatively connected to the cap assembly to permit water to exit the water vessel.

In another embodiment an in-wall pressurized water flushing system is located within a wall cavity and coupled to a water intake line. A pressurized water vessel has at least one opening and an actuator assembly is coupled to the vessel. A flexible hose connects the water intake and actuator. The cap assembly is removable from the pressurized vessel though an access panel in the wall while still attached to the flexible hose and the flexible hose has a length sufficient to remove the actuator though the access panel.

In yet another embodiment, an in-wall pressurized water flushing system is located within a wall cavity and coupled to a water intake line and operatively connected to a toilet. A pressurized water vessel storing water under pressure is located within a wall cavity. A waterproof jacket surrounds at least a portion of the pressurized water vessel. The jacket and vessel form a channel therebetween that is in fluid communication with the toilet.

DETAILED DESCRIPTION OF THE PREFERRED EMBODIMENTS

Figure 1:
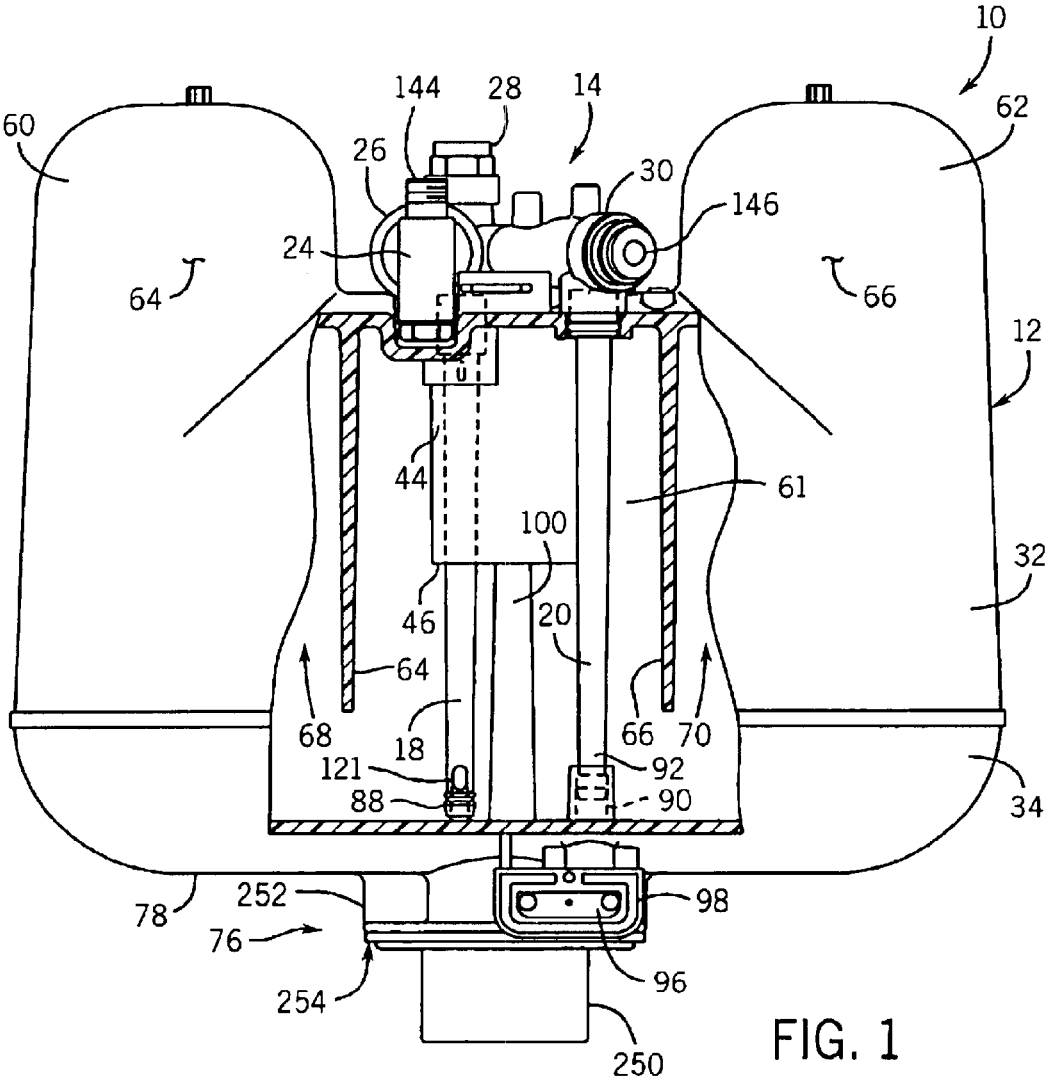
FIG. 1 is a schematic front view of a water closet system with a front portion broken away.
Figure 3:
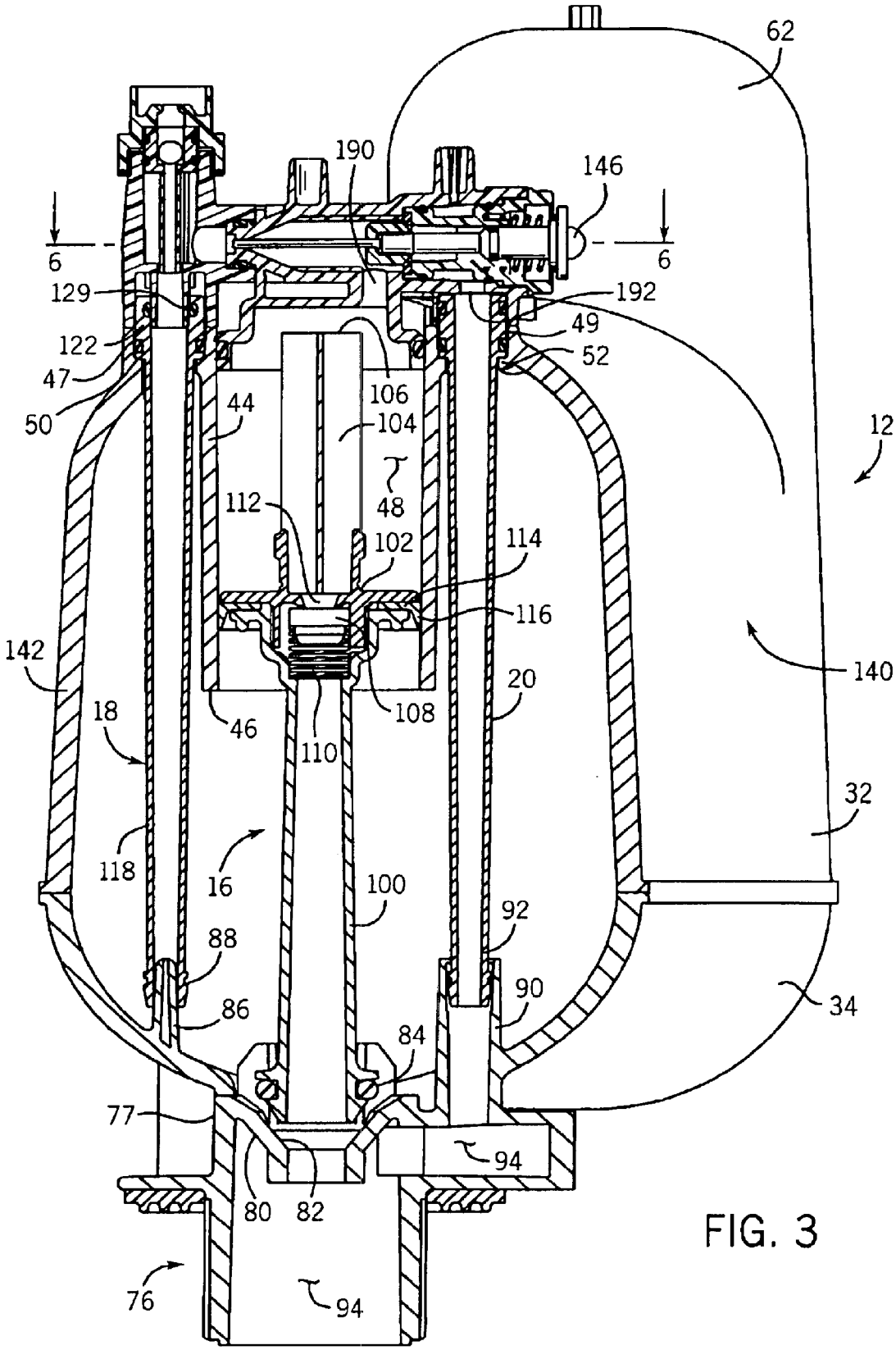
FIG. 3 is a partial cross-sectional view of the water closet of FIG. 1.

Referring to FIGS. 1 and 3, pressure assist system 10 includes a vessel 12 and a cap assembly 14 secured to the top of vessel 12. Housed in vessel 12 is a flush valve assembly 16, a fill tube 18 and a discharge tube 20. Cap assembly 14 is secured to vessel 12 with a plurality of o-rings and a retaining pin 22. The o-rings and retaining pin 22 permit easy assembly and removal of cap assembly 14. Cap assembly includes a vacuum breaker 24, a pressure regulator 26, an aerator 28 and an actuator 30.

Figure 4:
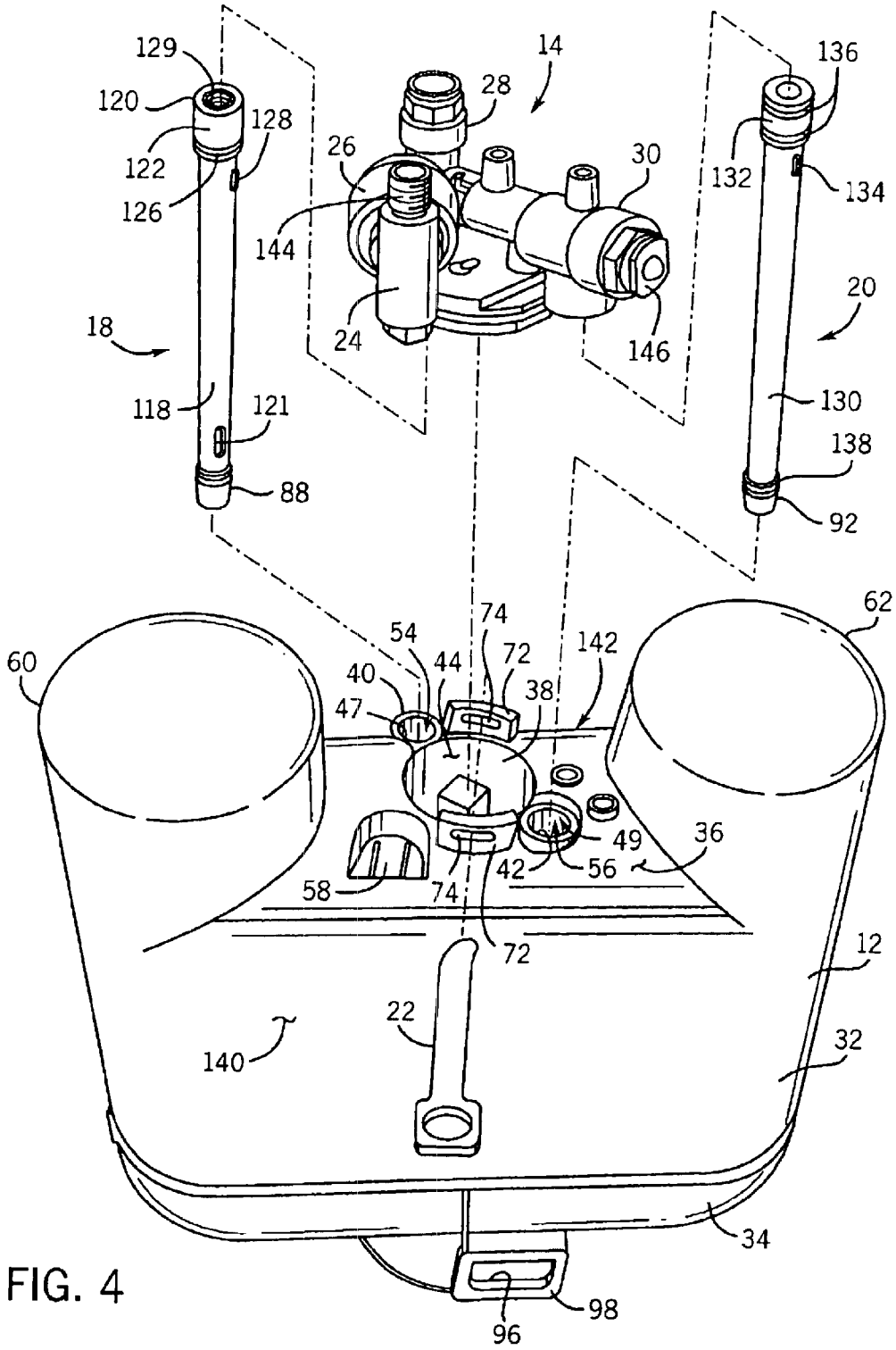
FIG. 4 is an exploded view of the water closet system.

Vessel 12 is formed from a top section 32 and a bottom section 34. Top and bottom sections 32, 34 are vibration welded to one another to form vessel 12. As shown in FIG. 4, top section 32 includes a top region 36 including a flush valve assembly opening 38, a fill tube opening 40 and a discharge tube opening 42. Extending downward from valve assembly opening 38 is a circular wall 44 having a free end 46 distal valve assembly opening 38. A flush valve cavity 48 is defined as the region between the valve assembly opening 38 and the free end 46 of the circular wall 44. Each of fill tube opening 40 and discharge opening 42 include a downwardly extending annular wall 47, 49 having a lower inwardly extending annular ledge 50, 52 respectively. A well 54, 56 is defined by annular walls 47, 49 and annular ledge 50, 52 respectively. Each annular ledge 50, 52 includes a key way opening 55, 57.

Top region 36 of top section 32 includes an inwardly extending regulator recess 58 configured to receive a portion of vacuum breaker 24. Top section 32 also includes two semi-hemispherical tower portions 60, 62 extending upward from top region 36 to form two air compression chambers., Top section 32 includes two downwardly extending walls, 64, 66 that effectively forms two separate regions or chambers 68, 70 below each tower portion 60, 62 respectively. Additionally, a third region 61 exits between walls 66 and 64.

Extending upwardly and outwardly from the top region 36 of top section 32 are a pair of ears 72. Each ear includes an opening 74 configured to receive a portion of pull-pin 22.

Turning now to bottom section 34, an extension 76 extends outward from the lower surface 78 bottom section 34. Extension 76 is configured to provide the connection between the vessel and the bowl or to a pipe leading to the bowl. Also extending from bottom section 34 within extension 76 is a valve seal surface 80. Valve seal surface 80 includes a beveled region 82 configured to sealing mate with a lower seal surface 84 of flush valve assembly 16.

Extending inwardly from the inner lower surface 78 of bottom section 34 is a post 86 configured to receive a first or lower end 88 of fill tube 18. Also extending inwardly from inner lower surface 78 of bottom section 34 is a discharge tube port or hollow tube 90 configured to receive a first or lower end 92 of discharge tube 20. Hollow tube 90 is in fluid communication with discharge region 94 and the inner region of extension 76. Bottom section 34 also includes a back pressure door 96 pivotally attached to door opening 98.

As illustrated in FIG. 3 flush valve assembly 16 includes a hollow lower stem portion 100, a pressure release valve 102, and an upper stem portion 104 with an uppermost end 106. Secured to the lower end of stem portion 100 is valve seal 84 that provides the seal against valve seal surface 80 of bottom section 34. Pressure release valve 102 includes a seal 108 biased by a spring 110 to seal the opening 112 between the upper stem portion 104 and lower stem portion 100. When the force coming from the pressure of the flush valve cavity 48 acting downwardly on the seal 108 is greater than the force of the spring acting upwardly on the seal 108, the seal is moved downward permitting fluid from flush valve cavity 48 to exit vessel 12 through hollow lower stem portion 100. An outer seal 114 is located about the periphery of the pressure relief valve 102 to create a seal between the flush valve cavity 48 and the rest of the area of vessel 12. The outer seal 114 includes a downwardly extending flange 116. Alternatively, flange 116 could include both a downwardly extending portion and an upwardly extending portion. Flange 116 helps to ensure the seal operates effectively. Upper stem portion 104 has a geometry such as an x-shape to permit fluid to enter the pressure release valve 102 from the flush valve cavity 48. Of course other geometry allowing fluid to enter the pressure release valve may also be used.

Referring to FIG. 4, fill tube 18 includes a hollow tube 118 having an upper end 120 and a lower end 88. Hollow tube 118 includes an aperture 121 to permit water to enter the interior of the vessel 12. Aperture 121 is located in bottom section 34 when fill tube 18 is secured within vessel 12. Hollow tube 118 includes an outwardly extending flange 122 proximate upper end 120. The outer diameter of the hollow tube 118 is less than or equal to the diameter of an opening 124 defined by the annular ledge 50 in fill tube well 54. The diameter of outwardly extending flange 122 is greater than the diameter of opening 124. An external o-ring 126 is located within a recess in the upper flange 122. O-ring 126 provides a lateral seal between the fill tube and the fill tube opening 40. A second o-ring 129 is located in the interior of hollow tube 118 to receive a portion of cap assembly 14 as described below. The fill tube 18 includes a key 128 extending outward from the hollow tube portion 118.

Similarly, discharge tube 20 includes a hollow tube portion 130 and an upper outwardly extending flange portion 132. A key 134 extends outwardly from hollow tube portion 130 proximate flange 132. Discharge tube 20 provides a path through which water can be discharged from the flush valve cavity 48 to discharge region 94 and through extension member 76 into the bowl as will be described below. A pair of spaced apart o-rings 136 is located within external recesses on flange 132. The lower o-ring 136 provides the seal between discharge tube 20 and vessel 12, while the upper o-ring 136 provides the seal between discharge tube 20 and a portion of cap assembly 14. A third o-ring 138 is located in an external recess located proximate lower end 92 to provide a seal between discharge tube 20 and vessel 12.

As noted above cap assembly 14 includes vacuum breaker 24, regulator 26, aerator 28, and actuator 30. In the preferred embodiment, vacuum breaker 24, regulator 26, aerator 28 and actuator 30 are arranged to fit between towers 60, 62 and substantially between a front wall 140 and rear wall 142 of vessel 12. In one embodiment, vacuum breaker 24, regulator 26, aerator 28 and actuator 30 are arranged in a non-linear fashion, with both an inlet 144, and actuator button 146 being located proximate front wall 140.

Figure 8:
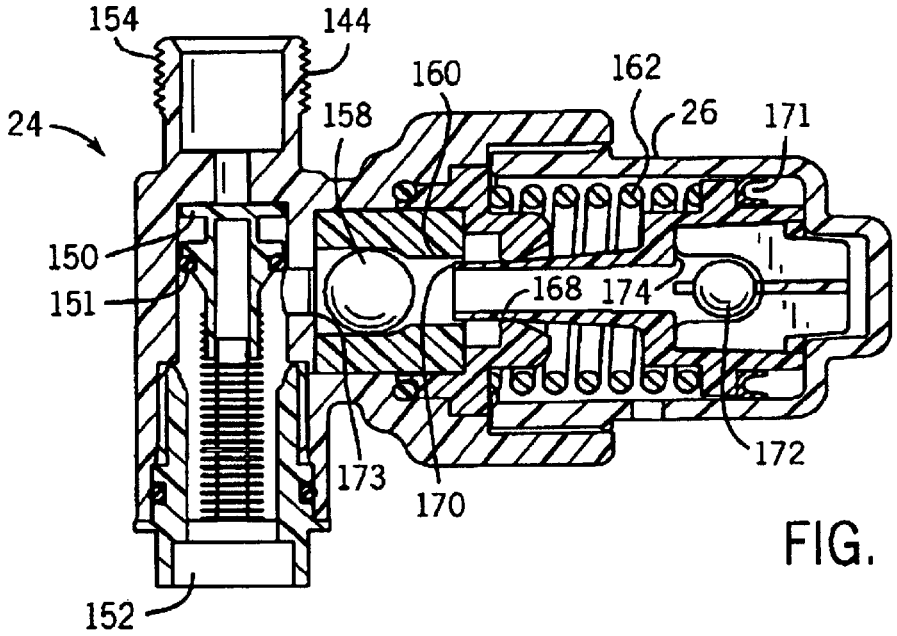
FIG. 8 is a cross-sectional view taken generally along lines 8—8 of FIG. 6.
Figure 5:
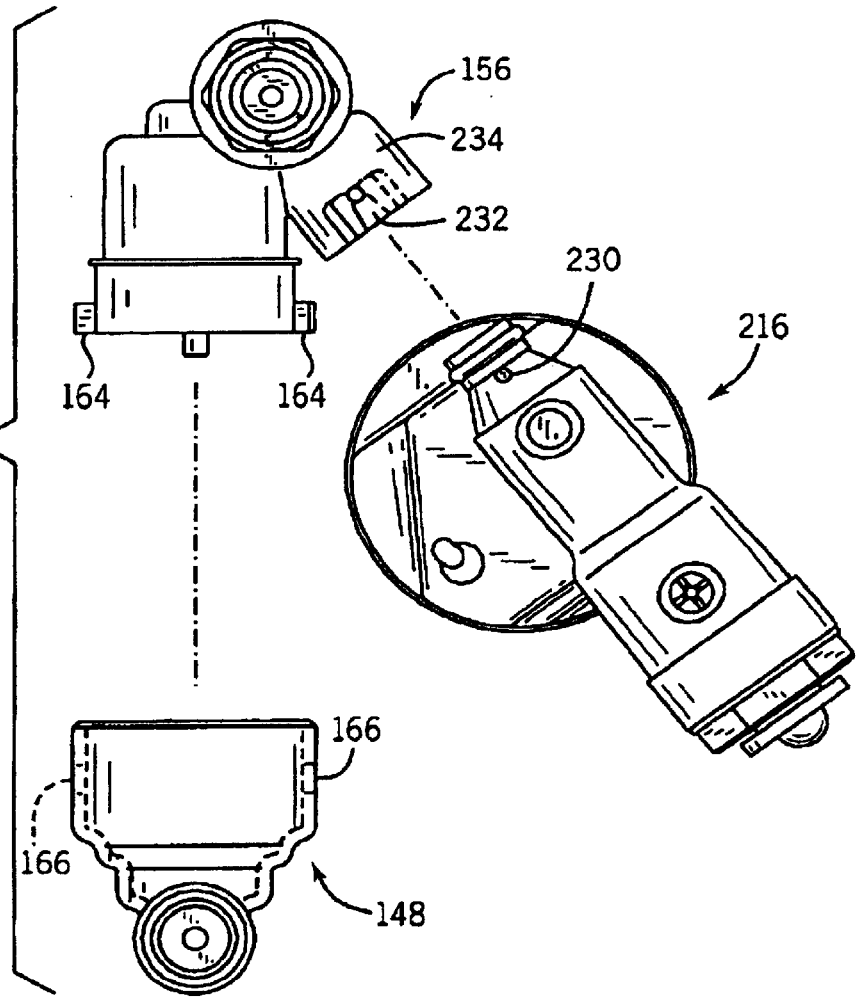
FIG. 5 is a partial exploded top view of the cap assembly.

As illustrated in FIG. 5, cap assembly 14 is formed from three detachable modules. Each module may be detached from the others without tools. The first module 148 includes the vacuum breaker 24 and part of pressure regulator 26. Vacuum breaker 24 works in conjunction with inlet 144 to prohibit the back flow of water from vessel 12 into the water supply line if a vacuum is created in the supply line. As illustrated in FIG. 8, when a vacuum is created in the water supply line, a plunger 150 is moved upward toward inlet 144 effectively permitting air from open end 152 to be introduced into the supply line. Movement of plunger 150 also provides an exit to atmosphere of any residual water within the tank in the event of such a vacuum in the supply line.

A water inlet feed line (not shown) is secured to inlet 144. The connection between the water inlet feed line and the inlet 144 may be any connection known in the art. Preferably, the connection is non-permanent. Since the connection may be located in a wall cavity, ideally, the connection would be a quick release attachment that does not require tools. A threaded connection 154 is shown in FIG. 8. When the water feed line is pressurized, water flows through inlet 144 and the pressure pushes spring biased plunger 150 downward allowing the water to flow into pressure regulator 26. An o-ring 151 forms a seal to prevent water from flowing out of open end 152.

Figure 6:
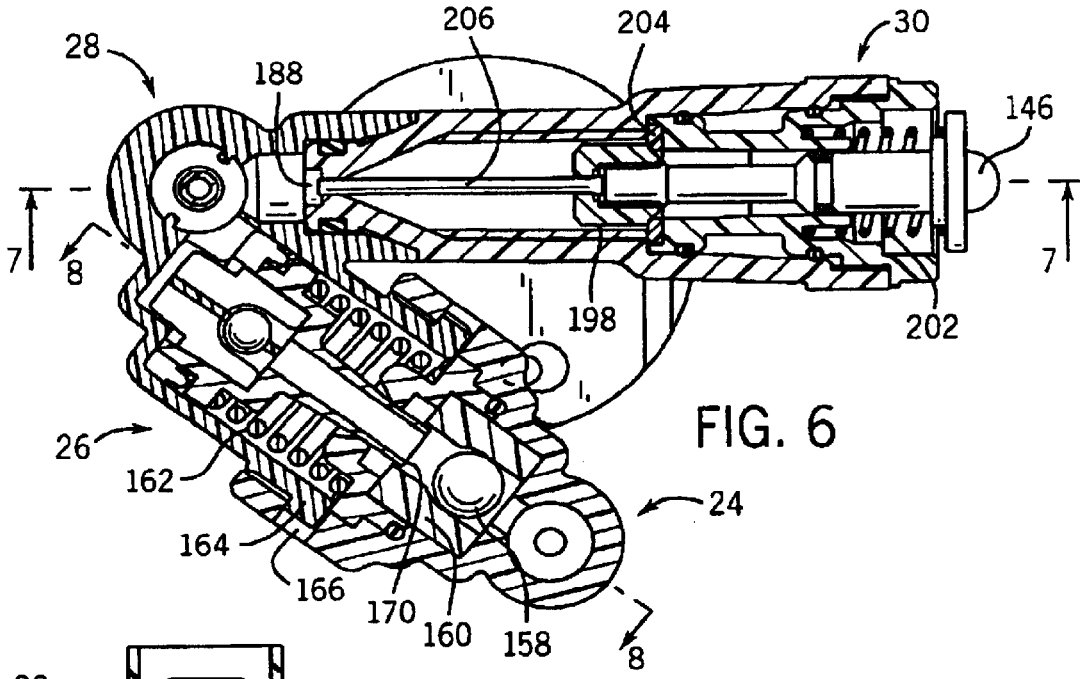
FIG. 6 is a cross-sectional view taken along lines 6—6 of FIG. 3.

Pressure regulator 26 is formed by assembling first module 148 to second module 156. First module 148 houses a first check valve ball 158 and check valve ball housing 160. This check valve ball 158 also acts as a seat to the orifice 170 of piston 168 as will be described below. A regulator spring 162 is captured in a preloaded state between first module 148 and the second module 156. First and second modules 148, 156 are secured to one another with a pair of tabs 164 on one module being received within a pair of slots 166 on the other module as illustrated in FIGS. 5 and 6. Regulator spring 162 biases a hollow piston 168 away from the first check valve ball 158. When pressure in vessel 12 causes a force acting on the seal 171 of piston 168 that exceeds the spring force of regulator spring 162 the orifice 170 of piston 168 moves toward check valve ball 158. The water pressure of the feed line forces check valve ball 158 against piston orifice 170 thereby shutting off the flow of water into the vessel 12. By selection of the spring force of spring 162, the maximum pressure within vessel 12 can be set. This ensures that vessel 12 will not be subject to pressure over a given design level, even if the water feed line pressure exceeds the design level. The first check valve ball 158 along with a second check valve ball 172 also serve to prevent back flow of water in the vessel when the pressure in the supply line drops below the pressure of the water in the vessel. When the pressure in the vessel 12 is greater than the supply line pressure, first and second ball valves 158, 172 engage seal surfaces 173, 174 respectively to prevent back flow of water from vessel 12 into the water supply line.

Figure 7:
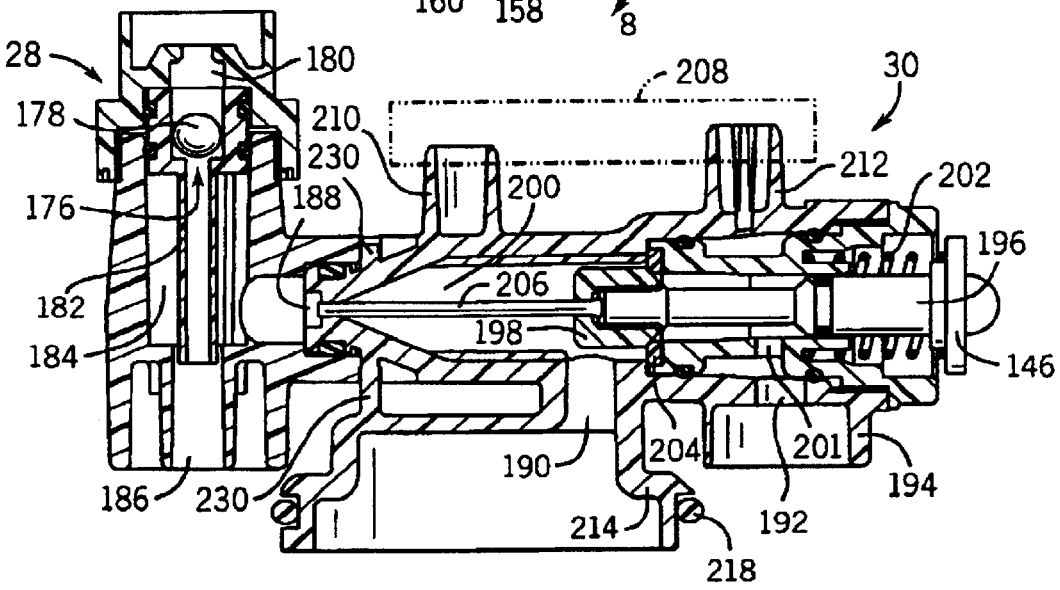
FIG. 7 is a cross-sectional view taken generally along lines 7—7 of FIG. 6.
Figure 9:
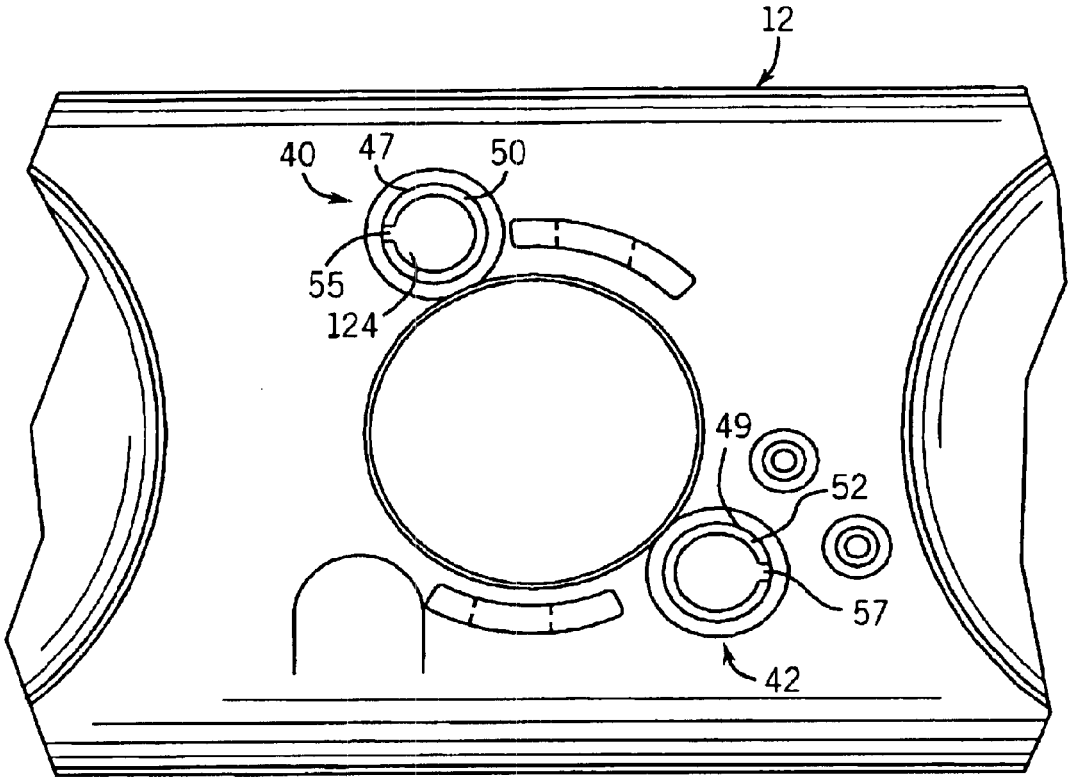
FIG. 9 is a partial top view of the vessel.

Referring to FIG. 7, second module 156 also includes aerator 28. With the vessel pressurized, the pressure within the vessel is the same pressure forcing the aerator ball 176 against its seat 180. During the discharge of water from vessel 12 into the bowl, the pressure drops within the vessel 12 and beneath the aerator ball valve 176. As soon as the pressure within the vessel 12 begins to drop, water from the supply line begins to flow through the regulator, past the aerator and into the vessel. As the vessel's internal pressure approaches atmospheric pressure, and incoming water continues to flow through the aerator and into the vessel, the design of the aerator initiates a venturi. Accordingly, ball 178 drops from its seat or sealing surface 180 and air is "sucked" into the vessel 12 along with the water. The aeration of the incoming water ensures that vessel 12 does not become water logged. Sufficient amount of air in system 10 provides sufficient energy to substantially clear vessel 12 of water during each flush. Once the pressure in vessel 12 is greater than the vacuum force of the venturi (i.e., ~1.5 psi at 50 psi supply pressure) ball 178 is pushed upward against sealing surface 180 and the flow of air into the tank is stopped. Aerator 28 includes a hollow tube 182 extending downward from aerator ball valve 176 into an inlet cavity 184 and terminating proximate the inlet of a lower portion 186. Water enters inlet cavity 184 from regulator 26 and flows around hollow tube 182 into lower portion 186 that is in fluid communication with fill tube 18 when cap assembly 14 is installed. The outer diameter of hollow tube 182 is less then the inner diameter of lower portion 186.

As shown in FIGS. 3, 6 and 7, actuator 30 includes a first opening 188 in fluid communication with inlet cavity 184 of aerator 28. Actuator 30 further includes an opening 190 in fluid communication with flush valve cavity 48 and another opening 192 in fluid communication with discharge tube 20. An extension 194 extends downward from actuator 30 proximate second opening 192 to receive discharge tube 20.

As discussed below, vessel 12 is flushed by reducing the pressure in flush valve cavity 48 thereby creating a pressure imbalance between the flush valve cavity 48 and the rest of the vessel 12. The pressure imbalance results in the flush valve assembly being moved upward off of sealing surface 80, and permitting water in vessel 12 to exit. In a first closed position illustrated in FIG. 7 actuator button is biased outwardly and water is prohibited from flowing from flush valve cavity 48 into discharge tube 20. When actuator button 146 is depressed to a second flush position, a path is created between opening 190 and opening 192, allowing water in flush valve cavity 48 to flow through actuator 30 and into discharge tube 20.

Actuator button 146 is attached to an actuator stem 196 having a stem base 198 and is located in actuator housing 200. A spring 202 biases stem 196 outwardly, such that stem base 198 is biased against a seal seat 204, preventing water from flowing from flush valve cavity 48 through actuator housing 200 and through valve body opening 201 and into discharge tube 20. When actuator button 146 is pressed inwardly against the force of spring 202, stem base 198 is moved off of seal seat 204 and water is able to pass through actuator housing 200 and into discharge tube 20. A pin 206 is attached to stem base 198 and extends through opening 188 that is in fluid communication with inlet cavity 184 of the aerator 28. In one embodiment the diameter of pin 206 is 0.086 inches and the diameter of opening 184 is 0.089 inches creating a small annular opening between the inlet cavity 184 of the aerator 28 and actuator 30. This small opening regulates the rate at which water can enter the flush valve cavity 48 to ensure that the flush valve assembly remains in the raised position for a sufficient amount of time to permit full evacuation of vessel 12 when flushed. Of course other diameters or shapes of the components may be employed to regulate the flow of water into flush valve cavity 48. It is possible to vary the size of the opening, thereby varying the flow rate into the flush valve cavity 48. Movement of pin 206 within opening 188 further acts as a self-cleaning device to keep opening 188 clear of debris.

In another embodiment, actuator 30 includes an electronic or automatic flush device 208 (shown in phantom) that includes a solenoid valve in conjunction with a sensor activator. The electronic device permits fluid to flow from the valve cavity 48 to discharge tube 20 through a first opening located in boss extension 210 and a second opening located in a second boss extension 212. Bosses 210, 212 may also serve to support the solenoid valve. As illustrated, actuator 30 may be manufactured with bosses 210, 212 with a solid bottom that could be drilled or punched to create openings, if the electronic actuator option is desired. In this manner a single actuator body may be used for both the manual actuator and electronic actuator.

Figure 2A:
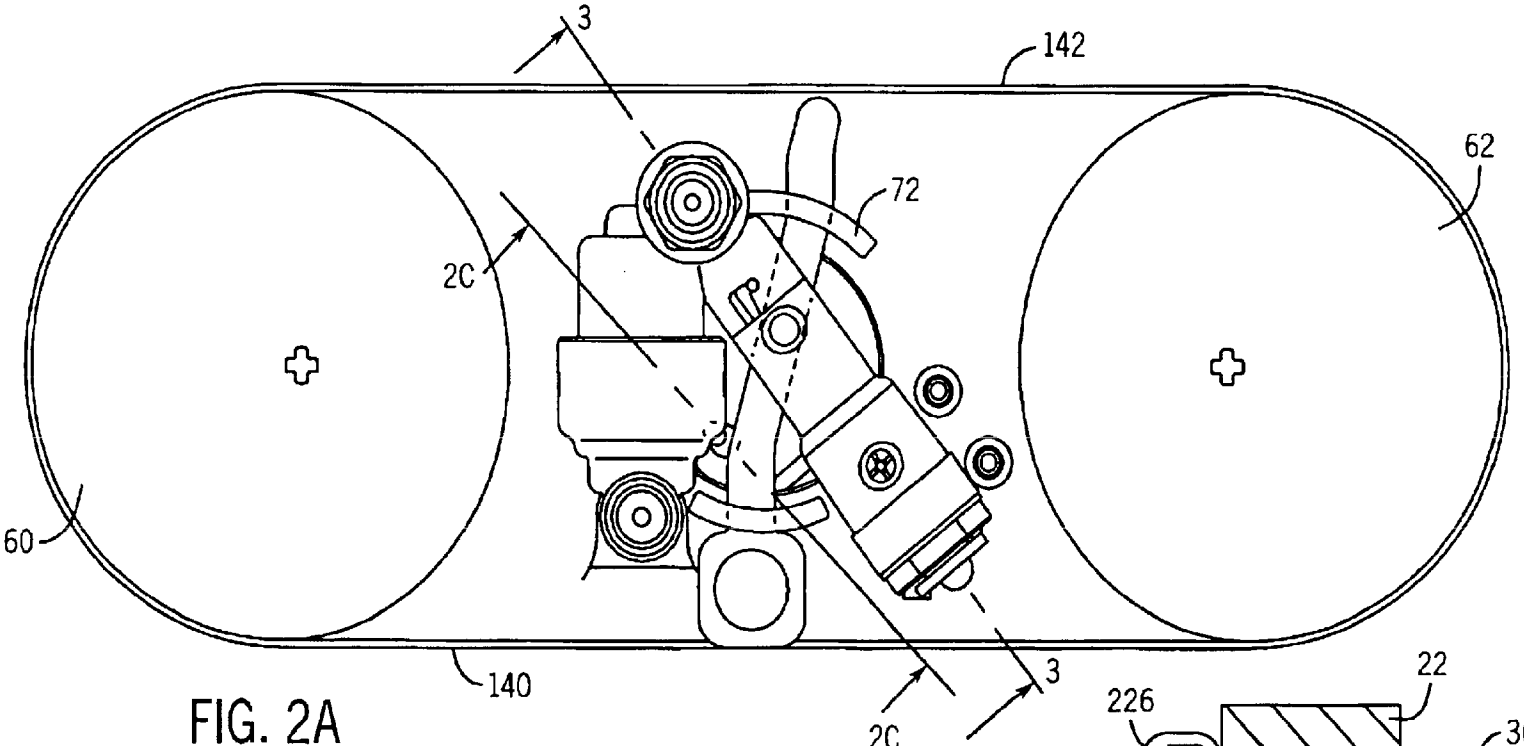
FIG. 2A is a top view of the water closet system with a pull pin fully seated.
Figure 2C:
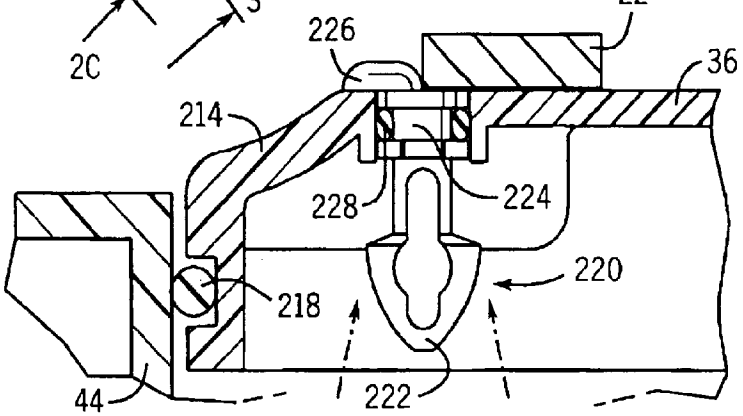
FIG. 2C is a partial cross-sectional view taken along a portion of line 2C—2C of FIG. 2A.
Figure 2B:
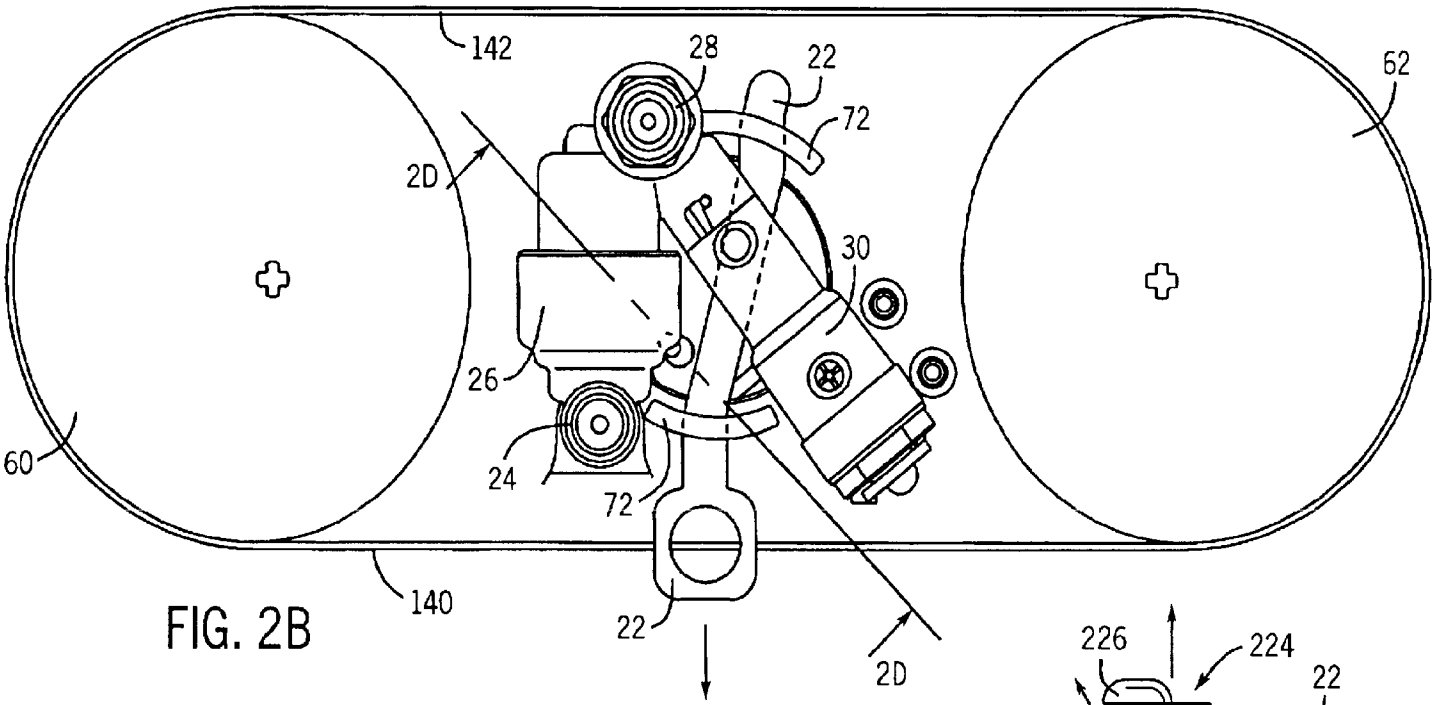
FIG. 2B is a top view of the water closet system with a pull pin partially withdrawn.
Figure 2D:
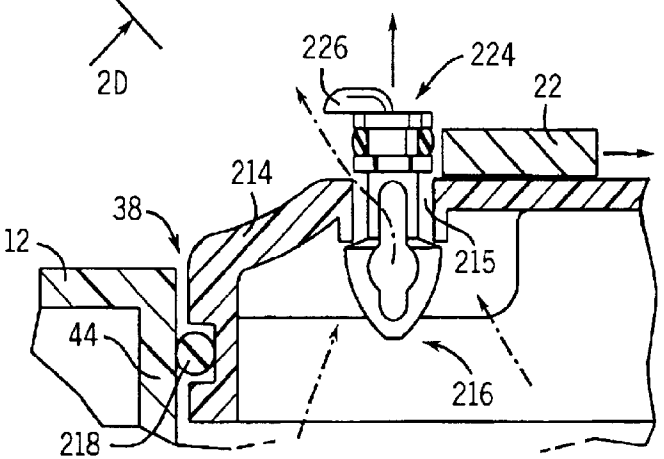
FIG. 2D is a partial cross-sectional view taken along a portion of line 2D—2D of FIG. 2B.

In the embodiment illustrated, actuator 30 along with a cover member 214 form the third module 216. Cover member 214 covers flush valve cavity 48. An o-ring 218 is attached to a lower portion of cover 214 and engages flush valve cavity wall 44 proximate opening 38 in vessel 12. Cover member 214 includes an opening 215 that receives a pressure relief valve 220 to permit release of pressure when cap assembly 14 is removed. Vent release includes a base portion 222 and an upper portion 224 with a tab extending from upper the top of upper portion 224. When pressure relief valve 220 is in the closed position as illustrated in FIG. 2C, the top of upper portion 224 is flush with the cover 214, and tab extension 226 overlies a portion of cover 214. Tab extension 226 serves to prohibit pressure relief valve 220 from falling into flush valve cavity 48. An o-ring 228 prohibits exchange of water or air from within flush valve cavity 48 and the atmosphere. Pin 22 as illustrated in FIGS. 2A and 2C overlies the top of upper portion 224 and locks pressure relief valve 220 in place until pin 22 is removed. As illustrated in FIGS. 2B and 2D, once pin 22 is moved outward uncovering pressure relief valve 220, any pressure in flush valve cavity 48 will move pressure relief valve 220 upward until the base portion 222 hits the underside of cover 214. In this manner water under pressure within flush valve cavity 48 is permitted to escape into the atmosphere. With this escape bath established, a flush is initiated as if the actuator were opened. Pressure relief valve 220 prevents pin support ears 72 from breaking as pin 22 is pulled outward and cap assembly 14 is force upward off of vessel 12.

The assembly of pressure assist system 10 will now be described in further detail. Top and bottom sections 32, 34 are welded together using a vibration welder or by means of an adhesive that can withstand the design pressure of vessel 12. Fill tube 18, discharge tube 20, flush valve assembly 16 and cap assembly 14 are then attached to vessel 12.

Referring to FIGS. 3 and 4, fill tube 18 is lowered into vessel 12 through opening 40, such that key 128 extends through key way 55. Lower end 88 of fill tube 18 is seated on post 86, and the lower portion of outwardly extending flange 122 is located within well 54 when full tube 18 is fully located in vessel 12. Fill tube 18 is then locked into place by rotating fill tube 18 until key 128 is moved away from key way opening 55. In the fully loaded and locked position o-ring 126 effectively seals fill tube 18 from vessel 12. The location of key 128 below annular ledge 50 prohibits upward movement of fill tube 18. The upper end 120 of fill tube 18 extends above the top region 36 of vessel 12 to receive the lower portion 186 of inlet cavity 184. The top region 36 of vessel 12 and fill tube 18 include indicia indicating whether fill tube is in a locked position with key 128 below annular ledge 50 or whether fill tube is in the unlocked position with key 128 in alignment with key way opening 55.

Similarly, discharge tube 20 is inserted into discharge tube opening 42 until lower end 92 of discharge tube 20 is seated within hollow tube 90. O-ring 138 attached to lower end 92 of discharge tube 20 maintains an effective seal to prohibit fluid flow between vessel 12 and discharge tube 20 or hollow tube 90. Discharge tube 20 is locked into place by rotating discharge tube 20 until key 134 is moved away from discharge key way opening 57 such that key 134 is under ledge 52. In the installed position the lower of two o-rings 136 serves to seal discharge tube 20 within opening 42 and the upper o-ring seals extension 194 of actuator 30. Indicia on both discharge tube 20 and vessel 12 indicate whether discharge tube 20 is locked into place with key 134 below ledge 52 or whether key 134 is in line with key way opening 57 and ready for removal.

Flush valve assembly 16 is lowered into vessel 12 through flush valve opening 38 until valve seal surface 84 of flush valve assembly is in contact with lower seal surface 80 of vessel 12.

As discussed above, cap assembly 14 is formed from thee separate modules 148, 156 and 216 that can be assembled and separated without the use of tools. In the illustrated embodiment, first module 148 including water inlet 144 and vacuum breaker 24 is formed as one piece with a first portion of regulator 26. Second module 156 includes the second portion of regulator 26 and aerator 28. Finally third module 216 includes actuator 30 and flush valve cover 214. First and second modules 148, 156 are attached by placing pair of tabs 164 within slots 166 and rotating the modules relative to one another to snap fit the tabs and slots together. Third module 216 includes a pair of cylindrical extensions 230 that are received within a pair of "L" shaped slots 232 in an extension 234 of second module 156. Second and third modules 156, 216 are attached by snap fitting the cylindrical extensions 230 within the shorter leg of the L-shaped slots 232.

Fully assembled cap assembly 14 is secured to vessel 12 by simultaneously placing lower portion 186 of inlet cavity 184 into fill tube 18; placing cover 214 into flush valve cavity opening 38; and placing extension 173 of actuator 142 over discharge tube 20. Internal o-ring 129 on fill tube 18 effectively seals lower portion 186 of inlet cavity 184 to allow water to enter fill tube 18. O-ring 218 on cover 214 effectively seals the cover 214 to wall 44 of flush valve cavity 48. Similarly, upper o-ring 136 on discharge tube 20 effectively seals extension member 194 on actuator 30.

Once cap assembly has been attached to vessel 12, pin 22 is inserted through openings 74 of ears or supports 72 until upper portion 224 of pressure relief valve 220 is covered by pin 22. A hose connected to the water supply line is coupled to inlet 144 by means of a threaded attachment or any other type of connection know to one skilled in the art. Once the water supply line is secured to inlet 144, and the vessel is secured to the water closet, vessel 12 is ready to be charged. Water entering inlet 144 under pressure flows through the vacuum breaker 24, regulator 26, and aerator 28 into fill tube 18 and finally into vessel 12 through opening 121 of fill tube 18. Some water also enters flush valve cavity 48 through opening 188 of actuator 30. As the water flows into vessel 12 the air in vessel 12 is compressed within each of tower 60, 62 and region 61. Water continues to enter vessel 12 until pressure in vessel 12 is equal to the water pressure in the water supply line or until the pressure in vessel 12 exceeds the spring force of regulator spring 162.

When the bowl is to be flushed, actuator button 146 is pressed inward moving stem base off of its seat 204 allowing water in the flush valve cavity 48 to escape through valve opening 201 and into the discharge tube 20 and out of vessel 12 through vessel exit 94. This escape of water from flush valve cavity 48 creates a pressure imbalance in vessel 12 and flush valve assembly 16 is lifted upward until the top of upper stem portion 104 hits the bottom of the cover 214. Once lower seat surface 84 of flush valve assembly 16 lifts off of valve seal surface 80, the water in vessel 12 is discharged through vessel exit 94 under pressure into the bowl. As the pressure in vessel 12 drops below the lower of the supply line pressure or the spring force of regulator 26, water enters vessel 12 from the water supply line. As discussed above, once the pressure in vessel 12 drops below the aerator pressure rate air is introduced into vessel 12 along with the entering water to prohibit system 10 from becoming water logged. In addition to water being fed into vessel 12 through fill tube 18, water is fed into flush valve cavity 48 through opening 188 in actuator 30 at a predetermined flow rate so as to cause the flush valve assembly 16 to gradually lower until lower seal surface 84 of flush valve assembly 16 reunites with seal surface 80 of vessel 12. The predetermined rate of flow through opening 188 in actuator 30 is sufficient such that all water contained within vessel 12 is discharged from vessel and also such that water can enter into the empty vessel and exit through the vessel to sufficiently refill the toilet's bowl prior to the resealing of lower seal surface 84 to seal surface 80 of vessel 12. This water continues to enter vessel 12 until pressure in vessel 12 is equal to the water pressure in the water supply line or until the pressure in vessel 12 exceeds the spring force of regulator spring 162. Once water no longer enters vessel 12, the system is ready to be flushed again.

When the system is to be repaired, the water source is shut off and vessel 12 is flushed to remove the pressure from within vessel 12. However, if vessel 12 is not flushed by depressing the actuator button 146, the system is automatically flushes as pin 22 is pulled outward from supports 72. As pin 22 is pulled outward from supports 72 pressure relief valve 220 is uncovered and pressure in flush valve cavity 48 will be reduced. This reduction in pressure in flush valve cavity 48 will result in flush valve assembly being lifted and water being flushed from vessel 12. At the point in which pressure relief valve 220 is uncovered, the pin is still within both openings 74. This prohibits the cap assembly from being pushed upward while the pin is only in one of the supports and possibly breaking it as a result. Once pin 22 is pulled fully from supports 72 the cap assembly 14 can be simply lifted off of vessel 12. If the line attaching the water line to water inlet is flexible, the entire cap assembly still attached to the flexible line can be removed from the wall and held over the bowl for testing. Alternatively, the cap assembly 14 or any module thereof may be removed for repair and/or replacement.

Water closet system 10 described above includes a number of different features that may be used either alone or in combination. Each feature may provide benefits to a water closet system if employed individually or if employed in combination with other features. The benefits of a number of the features outlined above will now be further addressed.

Fill tube 18 and discharge 20 both are locked to vessel 12 independently of cap assembly 14. One benefit of this locking feature is that pressure that would otherwise act on cap assembly 14 acts on fill tube or discharge tube 20 alone or on vessel 12 itself. The reduction of pressure on cap assembly 14 also results from the size difference between the outer o-ring 126 that provides the seal between fill tube 18 and the smaller inner o-ring 129 that provides the seal between fill tube 18 and cap assembly 14. Pressure in vessel 12 acts on the outer o-ring 126 but only the force from pressure acting on the inner o-ring 129 pushes up on cap assembly 14. Similarly, the pressure from vessel 12 acts on the outer o-ring 136 but no additional pressure acts on actuator 30 until a flush cycle is initiated. Another benefit of the fill tube 18 and discharge tube 20 remaining fixed to vessel 12 is that tubes 18 and 20 will also remain locked to vessel 12 when cap assembly is removed for repair or maintenance. This feature is a benefit when system 10 is used in an in-wall unit where the access door may be limited in size.

The interface between cap assembly 14 and vessel 12 provides a benefit regarding ease of assembly and repair. Prior art devices include components that are secured to the vessel with a separate gasket and a plurality of screws or a vertically mounted cylindrical cartridge requiring multiple rotations by means of a tool to disassemble. The use of o-ring seals and pin 22 for securing cap assembly 14 to vessel 12 permits assembly and disassembly without the use of any additional tools. Since no tools are required, when system 10 is used in an in-wall environment a smaller access panel may be provided in the wall. Pin 22 may be designed with a pre-bend along its length to provide a spring-load to offset the pressure applied to cap assembly 14 that would otherwise tend to push cap assembly 14 off of vessel 12. Alternatively, pin 22 may include bent portions that provide a downward spring force against cap assembly 14 when fully set within supports 72. Also the pull pin design could be replaced with a snap-ring style retainer. This allows removal from above which would permit removal of the cap assembly when the vessel is placed in a traditional china tank. The pull pin allows cap assembly to be released from vessel 12 by pulling pull pin 22 in a direction perpendicular to the wall right through the access panel. If the access panel is positioned at the same height of the pull pin, a person wishing to remove cap assembly 14 from within the wall, pull pin is simply pulled directly outward through the access panel in a simple linear motion. To fully remove cap assembly 14 through access panel, cap assembly only need be lifted a sufficient amount for the o-ring seals and lower portions of cap assembly to clear vessel 12. Since cap assembly may be removed while still attached to a flexible water feed line, cap assembly is simply pulled through the access panel to be inspected, repaired, or replaced. The Access panel may have a bottom portion that is slightly below the pull pin 22 and having an upper edge located a sufficient height to permit cap assembly 14 to be move upward a sufficient distance to clear the vessel.

Pressure relief valve 220 on cap assembly 14 minimizes the chance that one of ears 72 will break as pin 22 is removed from vessel 12. While it is possible to flush the system prior to removing pin 22, pressure relief valve provides an automatic flush if the user forgets to turn off the water and flush prior to disassembly. Without first removing the pressure from flush valve cavity 48, the support closer to front wall of vessel 12 may break due to the upward pressure on cap assembly 14 that would be concentrated on the single front support once pin 22 cleared the rear support 72. If a support 72 broke, the entire vessel would need to be replaced. Alternative securing devices may also be employed to replace the pin. For example, a rotating-pin or pins may be used that rotate into position over a portion of the cap assembly. A snap-ring may also be used, or any other mechanical fastener that can be used in conjunction with the o-ring seals to secure cap assembly to the vessel.

The geometry of cap assembly 14 provides a number of advantages. The non-linear arrangement of the components, allows the cap assembly to substantially fit between the front and rear walls of the vessel and between the towers. The geometry also allows the fill tube to be proximate the rear wall, and the discharge tube to be proximate the front wall. Additionally, the actuator button is proximate the front wall conveniently placed for access through the wall. The modular system of the cap assembly also allows for easy service of the components without the need for tools. Access to opening 188 in actuator 30 allows the area to be inspected and cleaned by simply twisting and pulling apart second and third modules 156, 216. Opening 188 provides the flow rate into the flush valve cavity 48 that controls the timing of system 10. Accordingly, it is helpful to have easy access to opening 188 to ensure it is clear of debris. Additionally, access to opening 188 also ensures more reliable inspection of opening 188 prior to assembly. The combination of vacuum breaker 24 and part of regulator 26 in first module 148 provides for a reduction in the number of parts. Each module is formed from a common unitary housing with additional components added as illustrated. The common unitary housing of the modules also serves to reduce component cost and the cost of assembly and repair.

Extension 76 includes a threaded connecting portion 250 that is either directly or indirectly coupled to the bowl via a pipe or the like. Because this extension 76 may be secured by means of a threaded nut to a china tank which is secured to a toilet bowl, any external force applied to the vessel 12 will be transmitted to the zone or mount 252 between the pressurized vessel and the extension 76. Unlike prior art, this zone 252 is not a pressurized zone. In this manner the failure mode has been eliminated or moved external from a pressurized portion of vessel 12. If force is applied to the connecting portion 250 either directly or through the bowl sufficient to crack the mount 252 just above the connecting portion 250, the failure will be in the non-pressurized region external to the pressurized portion of vessel 12. A failure to this zone 252 may necessitate replacement of vessel, however, the failure will not occur in the pressurized interior of the vessel.

Figure 10:
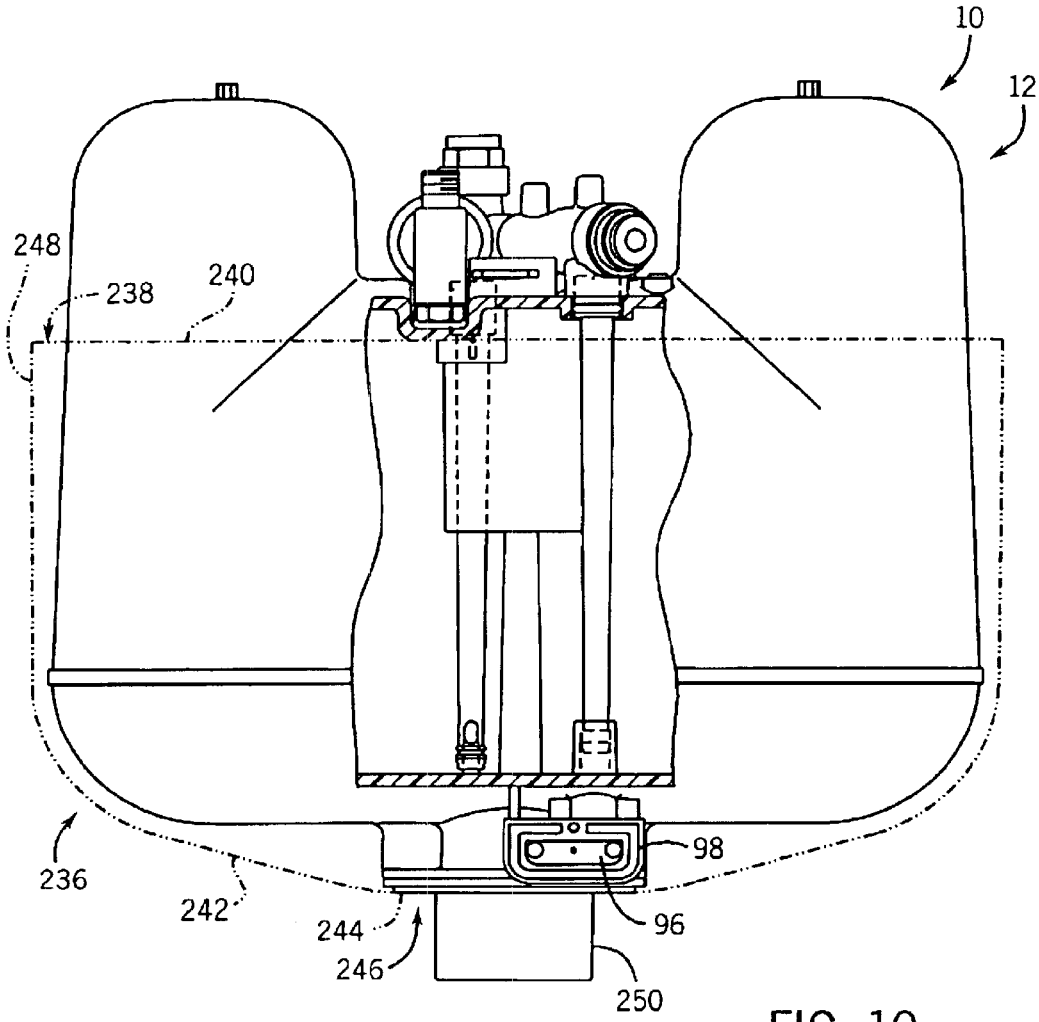
FIG. 10 is the view of FIG. 1 with a jacket surrounding the vessel.

Referring to FIG. 10 an outer sheath or jacket 236 may be used to substantially surround vessel 12 such that if a pressurized portion of vessel 12 leaks, water would be collected in jacket 236 and prevented from entering into the in-wall space. Jacket 236 includes an outer wall 248 extending completely around vessel 12 and extending from the bottom 254 of mount 252 toward the top region 36 of vessel 12. Jacket 236 terminates at an edge 240. Edge 240 is lower than the top region 36 of vessel 12 to provide free access to pull pin 22 and the cap assembly 14 for inspection, repair and/or removal and replacement. A bottom 242 of jacket 236 extends downward a non-horizontal angle to funnel any water that collects in the region 238 between vessel 12 and wall 248 of jacket 236 toward door 96. Any water than enters the collection region 238 will exit through door 236 and into the bowl. Jacket 236 includes an opening 246 that fits over connector 250. The lip around opening 246 sits against bottom 254 of mount 252. The nut that attaches a connector to a pipe or bowl sealing secures jacket 236 to bottom 254 of mount 252. Any water that is captured in collecting region 238 between vessel 12 and wall 248 flows though trap door 96 and into the toilet. In this way any liquid that escapes vessel 12 as a result of a leak does not leak within the wall cavity but is directed through trap door directly into the toilet. In one embodiment jacket 236 is formed of plastic and includes inwardly extending ribs or structure to maintain a separation between vessel 12 and wall 248 to form the collecting region 238. Alternatively, vessel 12 could include outwardly extending structure that would maintain the separation between vessel 12 and jacket 236. In another embodiment jacket 236 may cover the entire vessel. If jacket 236 covers the entire vessel, jacket 236 may also include either a removable hood portion covering the upper region of vessel 12, or alternatively an access panel permitting access of the cap assembly. In one embodiment, the access panel in the jacket could be substantially the same size as the access panel in the wall, or four inches by six inches, as one example. Further, jacket 236 may be formed of multiple pieces that interlock or otherwise fit together so long as water that leaks from vessel 12, or cap assembly 14 or the supply is captured within the jacket and exits through the drain. The height of the jacket as measured from the bottom of the vessel should be a height sufficient to accommodate a full flow of water from the supply line, if the connection between the supply line and cap assembly/vessel should leak given a supply line static pressure of 80 psi. The jacket or sheath acts as a secondary containment vessel and is there to absorb water from a leaking or ruptured supply line flowing unrestricted. In one embodiment, the jacket and drain have a sufficient size that permits an unrestricted flow of water from a supply line of 80 psi to exit through the drain without spilling into the wall cavity.

Each of the features described above may be used either alone or any combination with other features described. By way of example, but not a limiting example, the electronic actuator may be used with vessel 12 with or without the jacket 236. Accordingly, the scope of the invention is not limited to a water closet system in which all features described must be included in any specific combination. Further modifications may be made in the design, arrangement and combination of the elements without departing from the scope of the invention as expressed in the appended claims.

What is claimed is:

1. A pressurized water closet flushing system comprising:

a water vessel having at least one opening and two engageable retaining elements on opposite sides of said opening;

at least one o-ring a retaining pin;

a cap for removably covering the opening, wherein said cap is secured to the vessel with the at least one o-ring used to establish a sealing relationship between the cap and said opening in the vessel, and wherein the retaining pin is removably inserted into the two engageable retaining elements into an installed position wherein the retaining pin is slidably positioned over at least a portion of the cap to retain the cap in place; and a fill tube extending into the vessel and secured to the vessel, wherein the fill tube remains secured to the vessel when the cap is removed from the vessel.

2. The pressurized water closet flushing system of claim 1, wherein the fill tube is located in a fill tube opening in the vessel; and an o-ring sealingly engages the fill tube to the vessel.

3. A pressurized water closet flushing system comprising:

a water vessel having at least one opening;

a cap covering the opening;

a fill tube extending into the vessel and secured to the vessel, wherein the fill tube remains secured to the vessel when the cap is removed from the vessel, wherein the fill tube is located in a fill tube opening in the vessel and the fill tube includes a hollow longitudinal body defining a longitudinal axis, the fill tube including a tab protruding therefrom and received within a key way opening, the fill tube being prohibited from upward movement when the tube is rotated to move the key out of alignment with the key way opening; and an o-ring sealing engages the fill tube to the vessel.

4. The pressurized water closet flushing system of claim 3, wherein the o-ring is located on an outwardly extending flange of the fill tube, the vessel including an annular wall extending downward about the opening and terminating in an inwardly extending annular ledge, the o-ring sealingly engaging the fill tube and annular wall.

5. The pressurized water closet flushing system of claim 4, wherein a second o-ring sealing engages the fill tube with the cap.

6. A pressurized water closet comprising:

a water vessel having at least one opening, wherein the vessel includes a fill tube, a discharge tube, and a center cavity;

a cap removably secured to the opening, wherein the cap is sealed against the fill tube, discharge tube and center cavity with o-rings;

at least one o-ring sealing the cap and the water vessel; and means for releasably securing the cap to the vessel, wherein the means for releasably securing the cap assembly is a retaining pin.

7. The pressurized water closet of claim 6, wherein the cap includes an actuator connected to the center cavity and the discharge tube.

8. A pressurized water closet flushing system comprising:

a vessel operatively connected to a water supply line through a first opening and operatively connected to a toilet through a second opening;

a cap assembly sealingly engaged with the first opening and secured to the vessel with a fastener; and a pressure relief valve being closed when the fastener is positioned over the pressure relief valve in a fully engaged position and being released prior to the fastener being disengaged as the fastener is moved a predetermined distance from the fully engaged position.

9. The pressurized water closet flushing system of claim 8, wherein the cap assembly includes a cover portion, the pressure relief valve being located in the cover portion.

10. The pressurized water closet flushing system of claim 9, further including means for automatically flushing the vessel when the pressure relief valve is released.

11. A pressurized water closet flushing system for flushing a toilet comprising:

a vessel having a first upper opening operatively connected to a water supply line and a second lower opening operatively connected to the toilet; and a cap assembly operatively connected to the upper opening and formed from at least two separate modules, each module having a separate housing, the housings being releasably secured to each other without tools, wherein one module is operatively connected to the water supply line and including a vacuum breaker and at least a portion of a pressure regulator and the other module including an actuator, wherein one of the modules includes an actuator having an opening in fluid communication with the water supply line, and the opening being accessible when the module containing the actuator is separate from the other modules.

12. The pressurized water closet flushing system of claim 11, wherein the modules are releasably secured to one another with a snap fit.

13. The pressurized water closet flushing system of claim 11, wherein the modules are attached together in a non-linear arrangement.

14. The pressurized water closet flushing system of claim 11, wherein the vessel includes a first and second tower, the cap assembly being located between the towers.

15. The pressurized water closet flushing system of claim 11, wherein the vessel includes three modules, a first module including a vacuum breaker and at least part of a pressure regulator; a second module including an aerator and a third module including an actuator.

16. A pressurized water closet flushing system comprising:

a water vessel having at least one opening;

a cap covering the opening;

a discharge tube extending into the vessel and secured to the vessel, wherein the discharge tube remains secured to the vessel when the cap is removed from the vessel;

a fill tube extending into the vessel and secured to the vessel, the fill tube remaining secured to the vessel when the cap is removed from the vessel, wherein at least one of the fill tube and discharge tube is located in an opening in the vessel, wherein the fill tube includes a hollow longitudinal body defining a longitudinal axis, the fill tube including a tab protruding therefrom and received within a key way opening, the fill tube being prohibited from upward movement when the tube is rotated to move the key out of alignment with the key way opening; and an o-ring sealing engages the fill tube to the vessel.

17. A pressurized water closet flushing system comprising:

a water vessel having at least one opening contained therein, said water vessel being arranged and configured for installation into a wall space accessible through an access panel on one side of said water vessel;

a cap for removable installation on said water vessel to sealingly occlude said opening in said water vessel;

at least one engageable retaining element located on said water vessel;

a retaining member for removable engagement with said at least one engageable retaining element and said cap to retain said cap in position to sealingly cover said opening in said water vessel whenever said retaining member is engaged with said engageable retaining element located on said water vessel and said cap, said retaining member when disengaged from said engageable retaining element located on said water vessel and said cap allowing said cap to be removed;

wherein said retaining member may be disengaged from said engageable retaining element located on said water vessel through the access panel on one side of said water vessel; and wherein said cap may be removed from said opening in said water vessel through the access panel on one side of said water vessel following the disengagement of said retaining member.

18. A pressurized water closet flushing system as defined in claim 17, additionally comprising:

at least a second engageable retaining element located on said water vessel, wherein said engageable retaining elements are located on approximately opposite sides of said opening in said water vessel, and wherein said retaining member is arranged and configured to removably engage said engageable retaining elements and said cap to releasably retain said cap on said water vessel.

19. A pressurized water closet flushing system as defined in claim 18, wherein said engageable retaining elements each have apertures extending therethrough, and wherein said retaining member may be inserted consecutively through the aperture in one of said engageable retaining elements, over said cap, and through the aperture in the other of said engageable retaining elements to releasably retain said cap on said water vessel.

20. A pressurized water closet flushing system as defined in claim 17, wherein said retaining member comprises:

a retaining pin.

21. A pressurized water closet flushing system as defined in claim 17, wherein said water vessel has towers located on each side thereof with a top portion located therebetween, and wherein said opening in said water vessel is located in said top portion thereof which is located between said towers.

22. A pressurized water closet flushing system comprising:

a water vessel having at least one opening contained therein, said water vessel being arranged and configured for installation into a wall space accessible through an access panel on one side of said water vessel;

a cap for removable installation on said water vessel to sealingly occlude said opening in said water vessel;

a first engageable retaining element located on said water vessel located on one side of said opening in said water vessel;

a second engageable retaining element located on said water vessel located on an approximately opposite side of said opening in said water vessel from said first engageable retaining element; and a retaining member for removable engagement with said first engageable retaining element, said cap, and said second engageable retaining element to retain said cap in position to sealingly cover said opening in said water vessel whenever said retaining member is engaged with said first and second engageable retaining elements and said cap, said retaining member when disengaged from said first and second engageable retaining elements and said cap allowing said cap to be removed.

23. A pressurized water closet flushing system as defined in claim 22, wherein said first and second engageable retaining elements each have apertures extending therethrough, and wherein said retaining member may be inserted consecutively through the aperture in said first engageable retaining element, over said cap, and through the aperture in said second engageable retaining element to releasably retain said cap on said water vessel.

24. A pressurized water closet flushing system as defined in claim 22, wherein said retaining member comprises:

a retaining pin.

25. A pressurized water closet flushing system as defined in claim 22, wherein said water vessel has towers located on each side thereof with a top portion located therebetween, and wherein said opening in said water vessel is located in said top portion thereof which is located between said towers.

26. A pressurized water closet flushing system comprising:

a water vessel having at least one opening contained therein, said water vessel being arranged and configured for installation into a wall space accessible through an access panel on one side of said water vessel;

a cap for removable installation on said water vessel to sealingly occlude said opening in said water vessel;

at least one engageable retaining element located on said water vessel; and a retaining member for removable engagement with said at least one engageable retaining element and said cap to retain said cap in position to sealingly cover said opening in said water vessel whenever said retaining member is engaged with said engageable retaining element located on said water vessel and said cap, said retaining member when disengaged from said engageable retaining element located on said water vessel and said cap allowing said cap to be removed.

27. A pressurized water closet flushing system as defined in claim 26, additionally comprising:

at least a second engageable retaining element located on said water vessel, wherein said engageable retaining elements are located on approximately opposite sides of said opening in said water vessel, and wherein said retaining member is arranged and configured to removably engage said engageable retaining elements and said cap to releasably retain said cap on said water vessel.

28. A pressurized water closet flushing system as defined in claim 27, and wherein said retaining member may consecutively engage one of said engageable retaining elements, said cap, and the other of said engageable retaining elements to releasably retain said cap on said water vessel.

29. A pressurized water closet flushing system as defined in claim 26, wherein said retaining member comprises:

a retaining pin.

30. A pressurized water closet flushing system as defined in claim 26, wherein said water vessel has towers located on each side thereof with a top portion located therebetween, and wherein said opening in said water vessel is located in said top portion thereof which is located between said towers.

* * * * *